US010533382B2

(12) United States Patent
Andrigo

(10) Patent No.: US 10,533,382 B2
(45) Date of Patent: Jan. 14, 2020

(54) DEPLOYABLE BOW SPRING CENTRALIZER

(71) Applicant: TOP-CO INC., Houston, TX (US)

(72) Inventor: Gregory James Alexander Andrigo, Almonte (CA)

(73) Assignee: TOP-CO INC., Houston, TX (US)

( * ) Notice: Subject to any disclaimer, the term of this patent is extended or adjusted under 35 U.S.C. 154(b) by 0 days.

(21) Appl. No.: 15/758,270

(22) PCT Filed: Sep. 8, 2016

(86) PCT No.: PCT/US2016/050670
§ 371 (c)(1),
(2) Date: Mar. 7, 2018

(87) PCT Pub. No.: WO2017/044560
PCT Pub. Date: Mar. 16, 2017

(65) Prior Publication Data

US 2018/0245407 A1 Aug. 30, 2018

Related U.S. Application Data

(63) Continuation of application No. 15/258,671, filed on Sep. 7, 2016, now Pat. No. 10,214,973.

(60) Provisional application No. 62/215,604, filed on Sep. 8, 2015.

(51) Int. Cl.
*E21B 17/10* (2006.01)

(52) U.S. Cl.
CPC ..... *E21B 17/1078* (2013.01); *E21B 17/1028* (2013.01)

(58) Field of Classification Search
CPC ..... E21B 17/1078; E21B 17/1028
See application file for complete search history.

(56) References Cited

U.S. PATENT DOCUMENTS

| | | | |
|---|---|---|---|
| 6,719,063 | B2 | 4/2004 | Adams et al. |
| 7,775,272 | B2 | 8/2010 | Nelson et al. |
| 2002/0112853 | A1 | 8/2002 | Buytaert |
| 2011/0168388 | A1 | 7/2011 | Linaker |
| 2015/0027684 | A1 | 1/2015 | Jewett et al. |
| 2015/0034336 | A1 | 2/2015 | Morrison et al. |

OTHER PUBLICATIONS

International Search Report and the Written Opinion of the International Searching Authority as issued in International Patent Application No. PCT/US2016/050670, dated Nov. 28, 2016.

(Continued)

*Primary Examiner* — Michael R Wills, III
(74) *Attorney, Agent, or Firm* — Pillsbury Winthrop Shaw Pittman LLP

(57) ABSTRACT

A centralizer sub, and system, for enhanced access to subterranean zones from the surface as used in oil and gas wellbore installations to center a pipe or casing within a wellbore or previous casing string during run-in, installation, or cementing procedures. In under-reamed applications, casing strings and centralizers pass through a smaller casing string before opening up to a larger hole where repeated compressions and decompressions of bow strings of centralizers can compromise integrity and reliability. A centralizer sub, system, and method reduces and controls insertion and running forces to preserve centralizer integrity and down-bore surfaces and equipment.

10 Claims, 6 Drawing Sheets

(56) References Cited

OTHER PUBLICATIONS

Notice of Allowance as issued in U.S. Appl. No. 15/258,671, dated Oct. 12, 2018.
Non-Final Office Action for Related U.S. Appl. No. 15/258,671 dated Jun. 28, 2018, pp. 1 to 12.

DETAIL AN
SCALE 1 : 3

DETAIL AM
SCALE 1 : 3

DEPLOYABLE BOW SPRING CENTRALIZER

CROSS-REFERENCE TO RELATED APPLICATIONS

This is the U.S. National Stage of PCT/US2016/050670, filed Sep. 8, 2016, which in turn claims priority to U.S. Provisional Patent Application No. 62/215,604, filed Sep. 8, 2015 and U.S. patent application Ser. No. 15/258,671, filed Sep. 7, 2016, the entire contents of all applications are incorporated herein by reference in their entireties.

FIELD OF INVENTION

This disclosure describes centralizers for drilling, and in particular centralizers having selectively deployable longitudinal bow springs.

BACKGROUND

Centralizers are commonly used in oil and gas wellbore installations and generally serve to center a pipe or casing within a wellbore or previous casing string during run-in, installation, or cementing procedures. Conventional centralizers typically are characterized by a pair of opposed stop collars or stop rings with a number of outwardly-bowed springs extending longitudinally there between to contact the wellbore sidewalls and exert a centering force on the pipe or casing segment. Bow spring centralizer subs generally comprise a casing segment with pin and box connections and an integral bow spring centralizer. The centralizer sub is run as part of a casing string.

In under-reamed applications, the casing string (with centralizers) is passed through a smaller casing string (restriction) before opening up to a larger hole. Significant force is required to compress a bow spring centralizer and push it through a restriction. As drilling projects push to greater and greater depths, increased drilling angles, and through a greater variety of geological formations, more challenging demands are placed on centralizers and other down-bore equipment. For example, deeper wells require more stages and passage of centralizers through a greater range and number of corresponding restrictions.

Subjecting compressible bow strings to varied and varying pressures as it is passed down a well results in inconsistent, imperfectly predictable, and repeated strains.

Conventional bow springs can therefore suffer from a number of disadvantages in such installations. As the bore restrictions become tighter, the starting or insertion force and running forces required to pass restrictions increase. Additionally, compression of the bow springs through particularly tight restrictions can exceed the elastic range of the material, can lead to deformation of bow springs, and compromise the ability of the bow springs to restore and to center. Similarly, damaged or forced centralizers can damage down-bore surfaces and down-bore equipment. The repeated compressions and decompressions of the bow springs of the centralizers compromise the integrity and reliability of the centralizer.

Accordingly, the following discloses and enables improvements for reducing and controlling insertion forces and running forces and preserving centralizer integrity and down-bore surfaces and equipment against the increasing demands of deep-well drilling.

SUMMARY OF THE PREFERRED EMBODIMENTS

The present disclosure describes and enables a centralizer with bow springs selectively deployable down a wellbore.

The bows of the centralizer are elongated and compressed into a lower profile state and retained by a releasable locking mechanism. Maintaining a lower centralizer profile reduces frictional resistance and operational forces during tool insertion and run-in as the compressed centralizer bow springs more readily clear restrictions. The locking mechanism can then be selectively released to allow the restorative forces of the springs to centralize the casing within the bore. The locking mechanism can be released by controlled cyclical pressurization of the casing to actuate as described a rotational ratcheting release mechanism.

In one preferred embodiment, a portion of a locking mechanism is affixed to one of the centralizer stop collars while an interlocking portion is affixed to the casing. The locking mechanism is released by alignment of a release notch defined in a ratcheting ring with the interlocking portion of the locking mechanism affixed to the casing. Rotational misalignment of the ratcheting ring release notch and locking mechanism maintains the locked engagement of the lock mechanism portions while alignment results in release of the lock mechanism and deployment of the centralizer.

In another preferred embodiment, cyclical casing pressurization tensions one or more actuator bands wrapped about the casing with one actuator band end affixed to the casing and a free actuator band end acting on a ratcheting ring. Circumferential movement of the free end of the wrapped band during pressurization actuates the ratcheting band to decrease misalignment between the release notch and the lock mechanism and ultimately to release the lock mechanism and centralizer resulting in release of bow spring compression.

Accordingly, a deployable centralizer is maintained in a low-profile configuration with elongated, compressed bow springs until cyclical casing pressurization is selectively used to release a lock mechanism and allow for deployment of the centralizer bow springs.

BRIEF DESCRIPTION OF THE DRAWINGS

A more complete understanding may be derived by referring to the detailed description and claims when considered in connection with the Figures, wherein like reference numerals refer to similar elements throughout the Figures.

DETAILED DESCRIPTION OF PREFERRED EMBODIMENTS

The following description is of exemplary embodiments, but is not intended to limit the scope, applicability or configuration of the claims. Rather, the following description provides a convenient illustration for implementing various embodiments. Various changes may be made in the function and arrangement of the elements described in these embodiments without departing from the scope of the claims as set forth hereafter. This detailed description may be adapted and employed with alternatively configured devices having different shapes, components, material, or mechanisms, and the like, and still fall within the scope of the present claims. Thus, this detailed description of preferred embodiments describes and enables the claimed inventions and is for purposes of illustration and not limitation. Therefore, reference in the specification to "one embodiment" or "an embodiment" indicates that a particular feature, structure, or characteristic described in connection with the embodiment is included in at least an embodiment of the invention. The phrase "in one embodiment" or "an embodiment" do not necessarily refer to the same embodiment.

In the following description, certain terminology is used to describe certain features of one or more embodiments of the invention. For example, a "bow spring" as described herein may include, but is not necessarily limited to, a distinct formed component assembled with a pair of stop collars or an integral component formed from the same material stock as the stop collars. The stop collars and bow springs may be constructed from a wide variety of materials including, but not necessarily limited to, spring steel, metal, composite materials, carbon fiber, plastics, or any combination thereof. Any number of bow springs or combination of bow spring profiles or bow spring positions may be used in accordance with various embodiments.

Figure 1A:
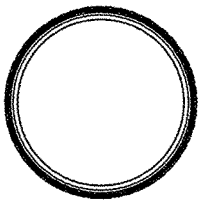
FIGS. 1A, 1B and 1C show a deployable centralizer embodiment with bows in a compressed configuration.
Figure 1B:
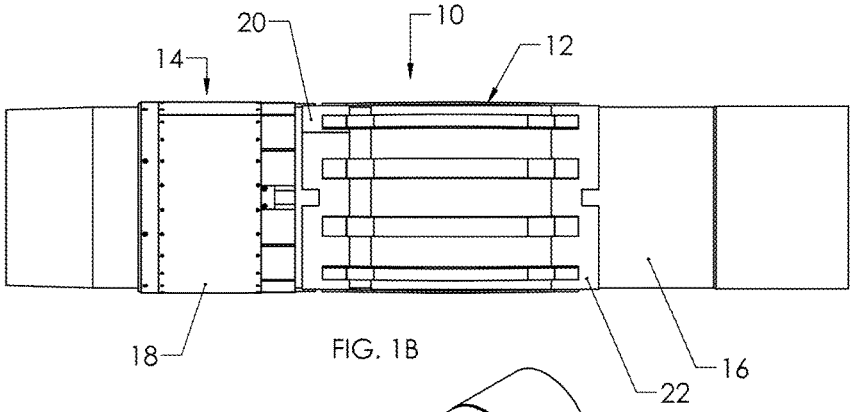
Figure 1C:
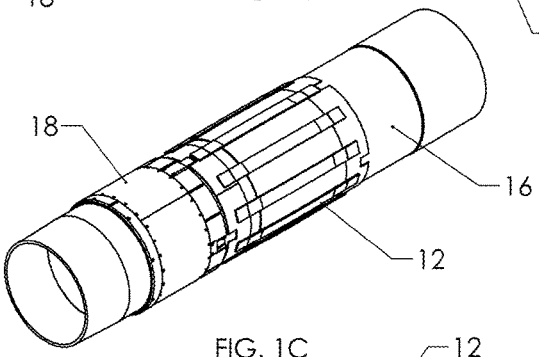
Figure 2A:
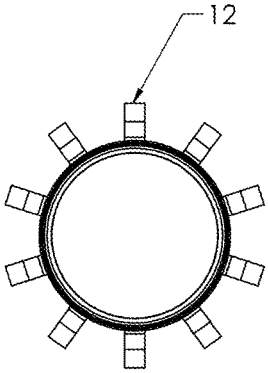
FIGS. 2A, 2B and 2C show a deployable centralizer embodiment with bows in a deployed configuration.
Figure 2B:
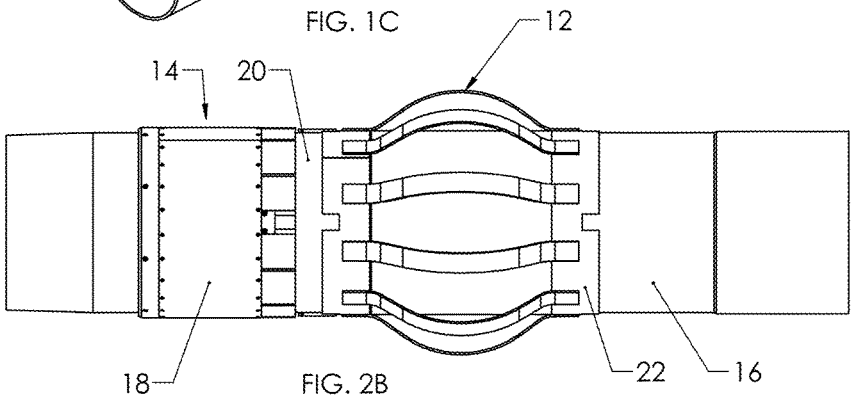
Figure 2C:
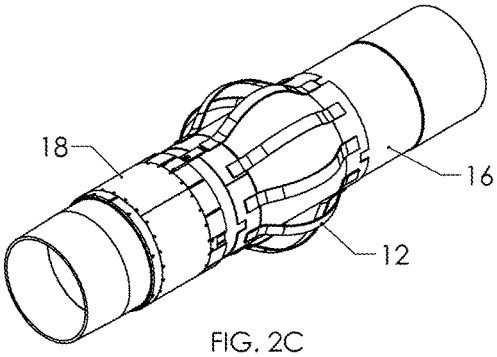

Aspects of the invention provide mechanisms for a centralizer 10 to be run down-hole in a low-profile, compressed state, and then deployed upon reaching a desired position or after clearing a particular bore restriction. A bow spring centralizer 10 has longitudinal bows 12 and a ratchet/lock mechanism 14 selectively actuatable to deploy longitudinal bow springs 12 about casing 16 once said centralizer 10 is positioned down-hole. With reference to FIGS. 1A, 1B and 1C, deployable centralizer 10 is shown in a compressed configuration prior to deployment of bows 12. FIGS. 2A, 2B and 2C show bow springs 12 in a deployed configuration. A cover 18 protects a series of ratcheting components and lock/release mechanisms from impact, debris, and from potential premature bow spring deployment. One centralizer stop collar 20 and the ratcheting mechanism 14 are secured to casing 16 with the other stop collar 22 translating from the ratcheting mechanism 14 during preloading of the bow springs 12 and rebounding towards the other stop collar 20 upon release of ratcheting mechanism 14.

In some embodiments, longitudinal bow springs 12 extend between two collars 20, 22 secured about casing 16. Collars 20, 22 are mechanically separated along the longitudinal axis of casing 10, e.g., via compression, to retract bow springs 12 into a configuration adjacent casing 16. Collars 20, 22 are maintained separated, and thereby bow springs 12 are in a retracted position via lock by ratcheting mechanism 14. Ratcheting mechanism 14 is selectively actuatable to release or deploy bow springs.

Figure 3:
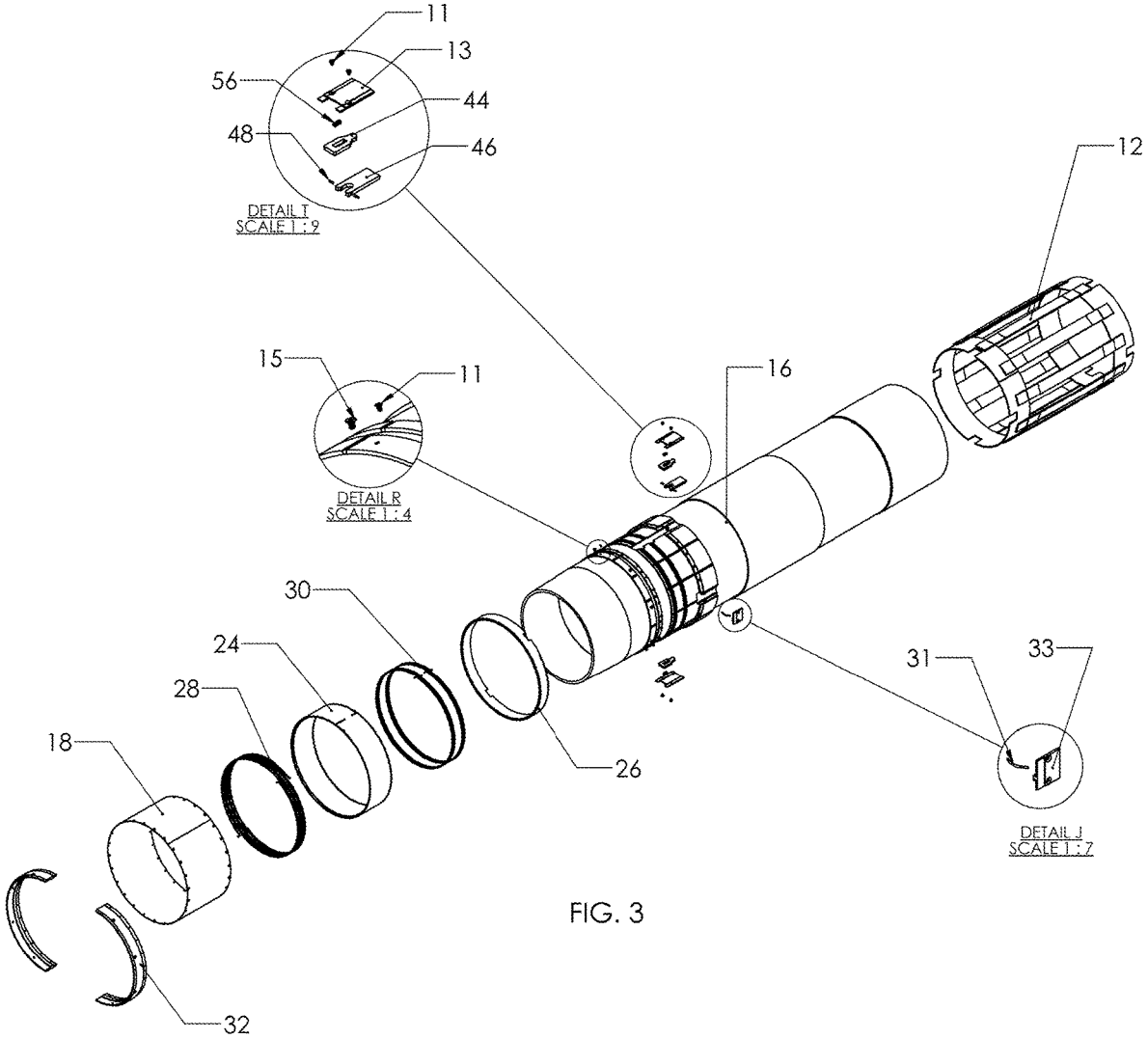
FIG. 3 shows an exploded view of the centralizer of FIGS. 1-2, including enlarged Detail views of locking mechanism and ratcheting components.

With reference now to FIG. 3, ratcheting mechanism 14 includes a series of ratcheting components configured such that retracted bow springs 12 are deployed by cyclical pressurization of casing 16. In some cases, ratcheting mechanism/components are axially arranged to achieve a low-profile locking mechanism.

In one such preferred embodiment the components of ratcheting mechanism 14 are stackably arranged as illustrated in FIG. 3 as follows. Ratcheting mechanism 14 includes an outer ratchet band 24, and inner ratchet band 26 with interlocking teeth, and compression/torsion springs 28 to urge outer and inner ratchet bands 24 and 26 into engagement. Two wrap band springs 30 are positioned under outer ratchet band 24 and attached to casing 16 and outer ratchet band 24. Circumferential expansion of casing 16 during pressurization causes circumferential tensioning of wrap bands 30 and rotation of attached outer ratchet band 24. Ratcheting mechanism 14 is protected by a cover 18 and end bands 32 to prevent damage during insertion and run-in. In some embodiments, wrap band springs 30 are removed and compression springs 28 cause rotation of outer ratchet band 24 in response to circumferential expansion of casing 16.

After centralizer 10 has reached a desired position or cleared a particular restriction, ratcheting mechanism 14 can be released to deploy bow springs 12. While various embodiments are described in terms of pressure activation, release of ratcheting mechanism 14 can be accomplished also using any number or combination of mechanical actuators, thermal actuators, pressure actuators, or other suitable selective means for actuation of devices down-hole.

Figure 6A:
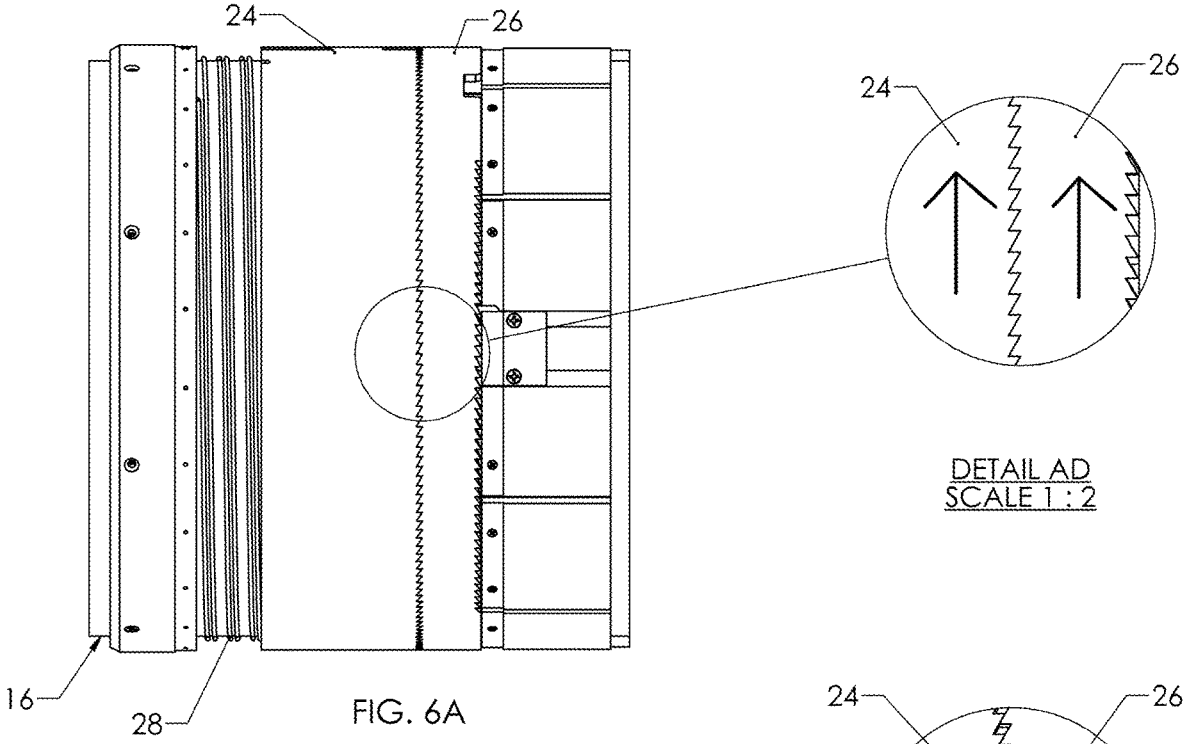
FIGS. 6A-6B show the interaction and operation of interlocking ratcheting rings and ratchet spring latch
Figure 6B:
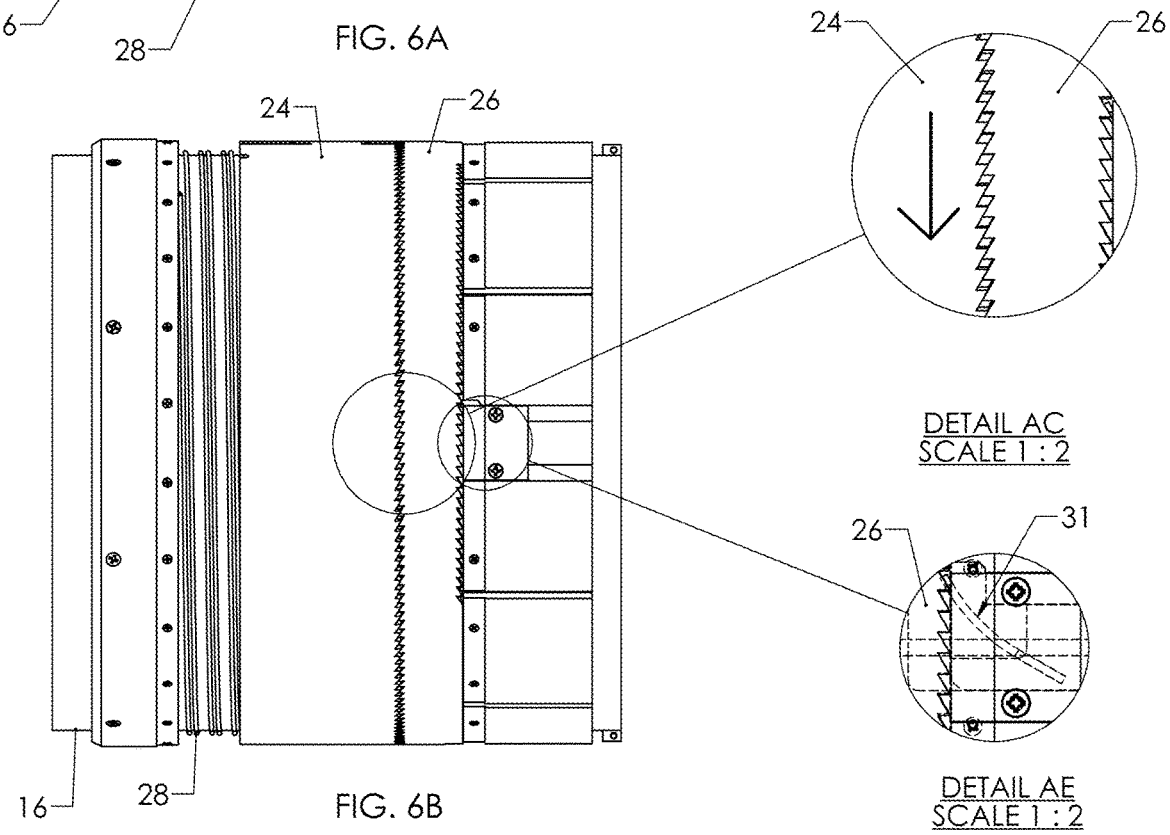

When sufficient pressure is applied inside of casing 16, the outside diameter of the casing 16 expands. A predetermined increase in pressure will result in a determinable expansion of the diameter of casing 16. The extent of expansion depends on the casing size, its wall thickness, and materials used. The activation pressure may be measurably different for a 7" casing, or a 16" casing, or a 13⅜" casing. Therefore target activation pressures can be determined and the locking mechanism designed to be activated by the predicted pressure at a predetermined depth or location. Designing the system around the casing expansion that will occur at a desired depth or location provides flexibility and reliability. As casing 16 expands, wrap band springs 30 are tensioned between casing 16 and outer ratchet band 24, causing rotation of outer ratchet band 24 about casing 16. Rotation of outer ratchet band 24, in turn causes rotation of interlocking inner ratchet band 26. (See FIG. 6A and detail AD). When this increased pressure is released, one or more compression/torsion springs 28 urge outer ratchet band 24 toward the original pre-pressurization position. (See FIG. 6B and detail AC). Wrap bands 30 can include any number of partial or full windings about casing 16 to achieve a desired circumferential tension and corresponding movement of a free end of wrap band 30 in response to a given pressurization and circumferential expansion of casing 16. The latch or locking portion of ratchet mechanism 14 comprises numerous components that work together as illustrated in FIGS. 3, 4A and 4B.

A ratchet spring lock 31 engages inner ratchet 26 to ensure unidirectional rotation and prevent inner ratchet 26 from rotating backwards with the outer ratchet band 24 when the pressure is released. Ratchet spring lock 31 is protected from debris by ratchet spring lock cover 33. Thus, selective cyclical pressurization of casing 16 causes outer ratchet band 24 to rotate back and forth, which in cooperation with spring lock 31 produces a ratcheting reaction between outer ratchet band 24 and inner ratchet band 26.

Figure 4A:
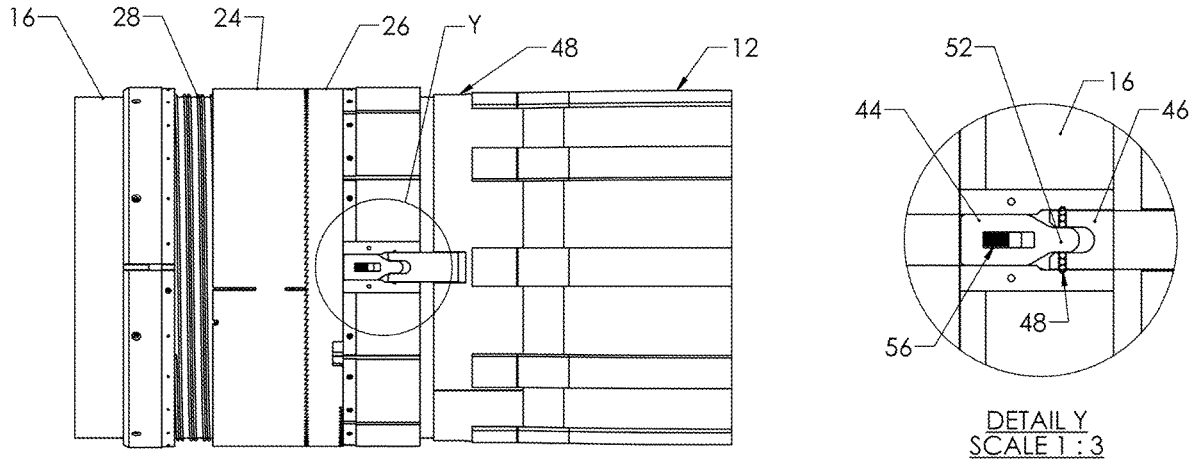
FIGS. 4A-4B show side views of the ratcheting and locking mechanism components and Detail views of the locking mechanism used to secure and subsequently deploy the centralizer bows.
Figure 4B:
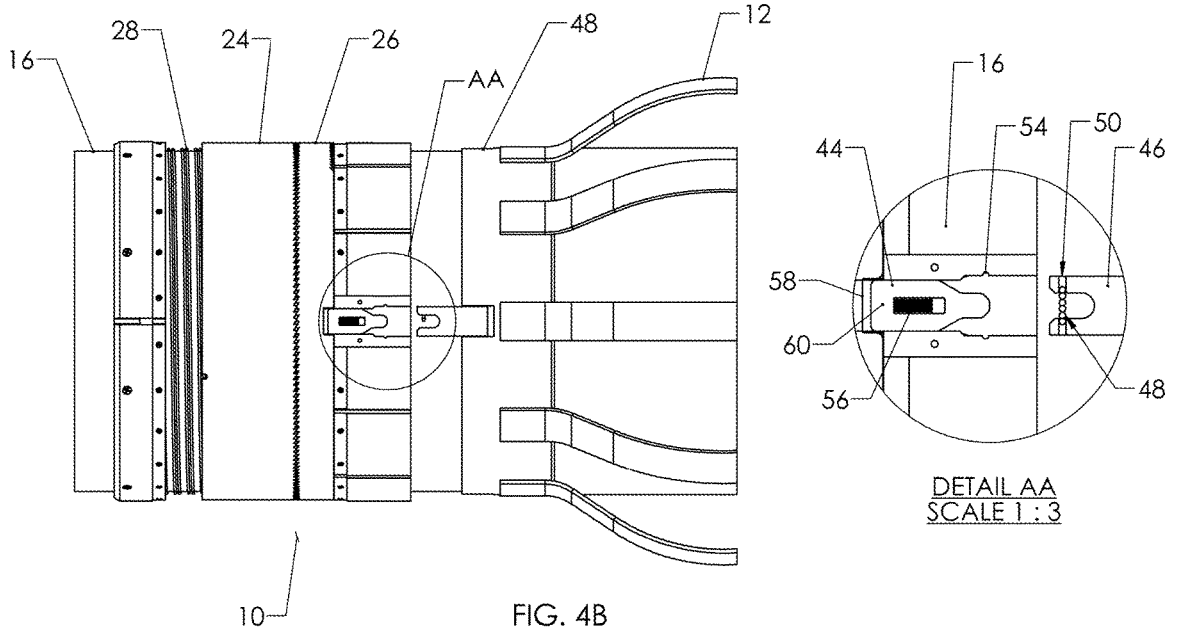
Figure 5A:
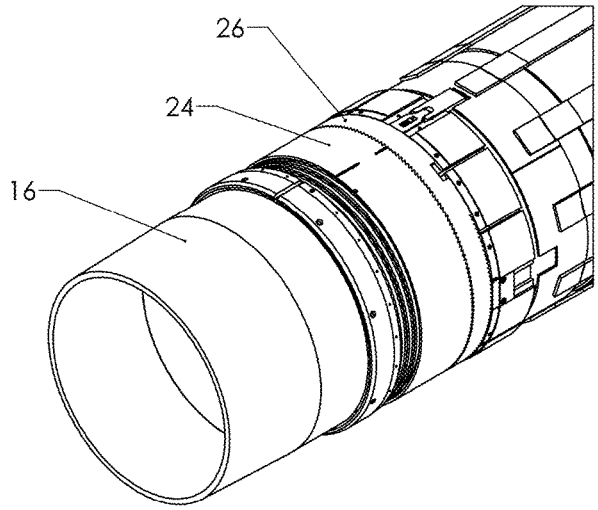
FIGS. 5A-5B show perspective views of the ratcheting components and a Detail view showing rotational misalignment of the release notch and locking mechanism used to deploy the centralizer bows.
Figure 5B:
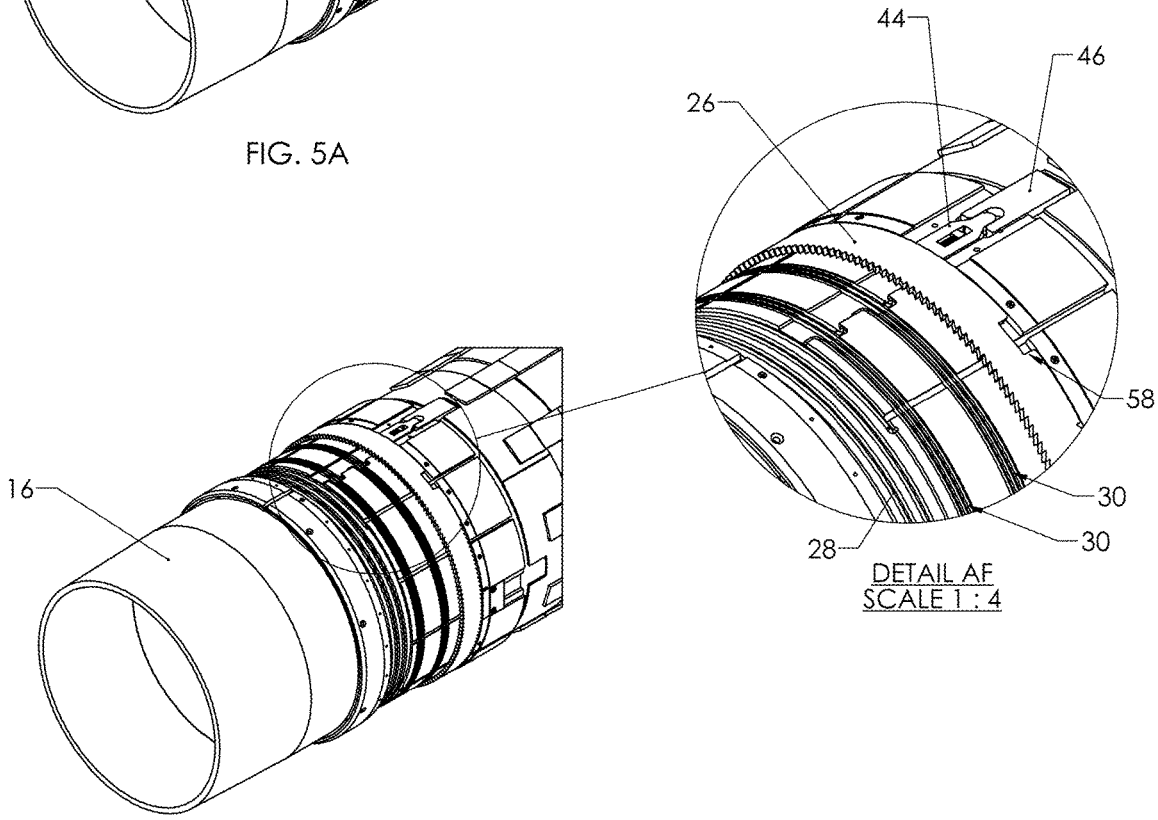

With reference to FIGS. 4A and 4B, tab 44 affixed to casing 16 interfaces with a receptacle 46 integral with or welded to one collar 48 of centralizer 10. In some embodiments, receptacle 46 includes an aperture for receiving tab 44. Bow springs 12 of centralizer 10 are compressed until receptacle 46 engages with tab 44. Ball bearings 48 are inserted into holes 50 defined in receptacle 46 and held in place by the nose 52 of tab 44. In one preferred embodiment, ball bearings 48 protrude into recesses 54 defined in casing 16 to provide shear resistance between receptacle 46 and casing 16 to maintain centralizer bow springs 12 in a compressed state.

Tab 44 is biased by a spring 56 to retract from receptacle 46 when aligned with release notch 58 defined on the inner ratchet band 26. Upon predetermined rotation of inner ratchet band 26, nose 52 of tab 44 retracts from receptacle 46 as tail 60 of tab 44 withdraws into release notch 58. Upon withdrawal of nose 52 of tab 44 from receptacle 46, ball bearings 48 are dislodged from recesses 54, allowing centralizer bow springs 12 to deploy.

With continued reference to FIG. 4A, deployable centralizer 10 is preloaded for run-in with tab 44 seated within receptacle 46 and release notch 58 defined by inner ratchet band 26 rotationally offset a predetermined amount from tab 44. When centralizer 10 has reached a desired position or depth down-hole, the casing pressure is selectively cycled or pulsed repeatedly until inner ratchet band 26 is positioned to align release notch 58 with tab 44, as shown in FIG. 4B. The number of pressure pulses required to deploy centralizer bow springs 12 can be customized or preset by selective positioning of release notch 58 relative to tab 44. Stated otherwise, rotational offset between release notch 58 defined by inner ratchet band 26 and tab 44 can be selected to establish the number of pressure cycles required for subsequent alignment to thereby release tab 44. For example, a ratchet tooth pitch and rotational offset can be selected to require ten pressurization cycles.

Alternate embodiments include the use of multiple locking mechanisms to selectively release the bow spring centralizer. Such embodiments include a plurality of release notches 58 formed in inner ratchet ring 26, a plurality of tabs 44, and plurality of receptacles 46, and related components.

Figure 7A:
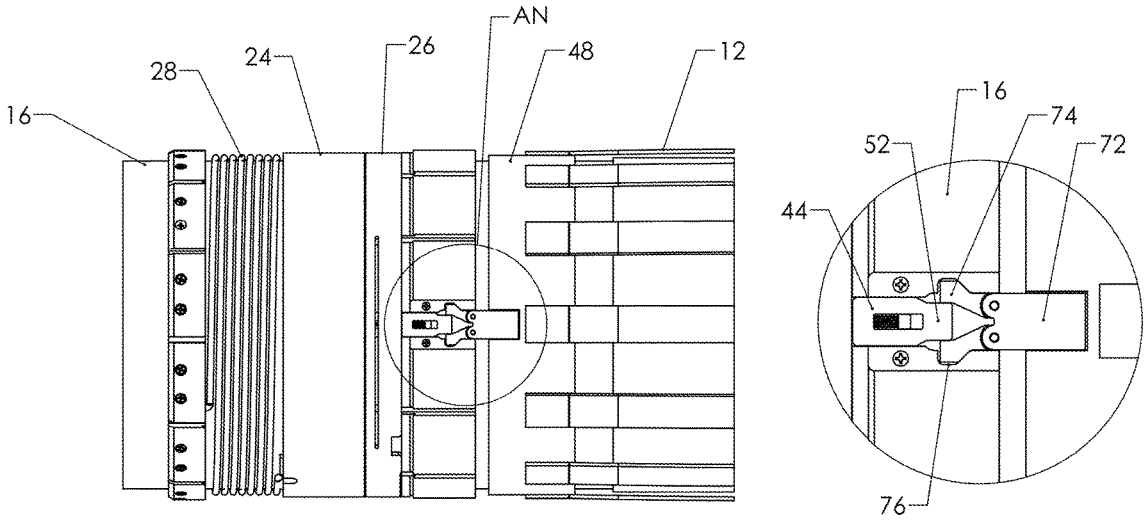
FIGS. 7A-7B show side views of an alternative embodiment of the ratcheting and locking mechanism components and Detail views of the locking mechanism component used to secure and subsequently deploy the centralizer bows.
Figure 7B:
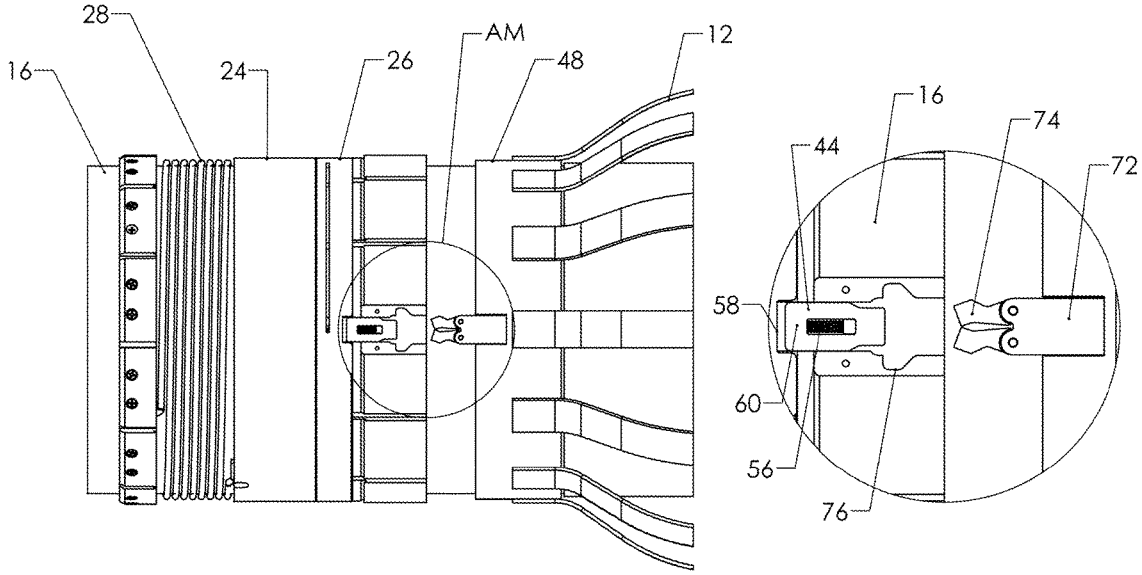

With reference to FIGS. 7A and 7B, in one preferred embodiment, receptacle 72 includes two pivoting appendages 74 capable of engaging recesses 76. Tab 44 maintains appendages 74 apart from each other and engaged with recesses 76. Upon predetermined rotation of inner ratchet band 26, nose 52 of tab 44 retracts from receptacle 72 as tail 60 of tab 44 withdraws into release notch 58. Upon withdrawal of nose 52 of tab 44 from receptacle 72, appendages 74 collapse and are dislodged from recesses 76, allowing centralizer bow springs 12 to deploy.

While various embodiments are described in the context of wellbore applications, centralizer 10 and ratcheting mechanism 14 described herein may provide similar advantages in other applications. Finally, while this description describes and enables various exemplary embodiments, many changes, combinations, and modifications may be made to any of the exemplary embodiments without departing from the scope of the claims. These alternatives can be suitably selected depending upon the particular application or in consideration of any number of factors associated with the operation of the device. These and other changes or modifications are intended to be included within the scope of the present claims.

The invention claimed is:

1. In a casing sub having a deployable bow spring centralizer, a selectively releasable locking mechanism comprising:

a receptacle;

a tab capable of engaging said receptacle; a member to bias said-locking mechanism;

a first ratchet band capable of circumferential movement about said casing sub, said first ratchet band forming one or more release notches;

a second ratchet band capable of circumferential movement about said casing sub, said second ratchet band capable of engagement with said first ratchet band, said second ratchet band forming a notch capable of receiving a spring end;

a compression spring having a first end and a second end and fitted around the circumference of said casing sub, said first end forming a spring end;

at least one wrap band spring positioned under the second ratchet band; and an end band mounted to said casing sub adapted to prevent rotational movement of said end band relative to the casing sub, said end band forming a notch to receive said second end of said compression spring.

2. The releasable locking mechanism of claim 1 wherein said deployable bow spring centralizer includes said receptacle.

3. The locking mechanism of claim 1 wherein said second end of said compression spring is adapted to engage the exterior of said casing sub.

4. The locking mechanism of claim 1 wherein said receptacle is formed as an integral part of said bow spring centralizer.

5. The locking mechanism of claim 1 wherein said receptacle defines holes, and wherein ball bearings in said holes engage recesses in said casing sub, and wherein upon engagement of said receptacle with said tab, a nose of said tab maintains said ball bearings in said recesses to prevent movement of said bow spring centralizer.

6. The locking mechanism of claim 1 wherein said tab includes pivoting appendages capable of engaging said recesses in said casing sub, said pivoting appendages being held apart by said tab.

7. In a casing sub having a deployable bow spring centralizer, a selectively releasable locking mechanism comprising:

a receptacle connectable to said bow spring centralizer, said receptacle being capable of engaging a corresponding tab and capable of engaging recesses defined in said casing sub; wherein engagement of said receptacle with said tab maintains said bow spring centralizer in a compressed state;

a tab affixed to said casing sub and moveable between an engaged position and a disengaged position relative to said receptacle, wherein said tab, in said engaged position, engages said receptacle, and wherein said tab, in said disengaged position, does not restrict movement of said receptacle and said bow spring centralizer;

a tab biasing spring, said tab biasing spring having a compressed state and a relaxed state, wherein said tab biasing spring is in its compressed state when said tab is engaged with said receptacle, and wherein said tab biasing spring urges said tab to transition to said disengaged position;

a first ratchet band capable of circumferential movement about said casing sub, said first ratchet band having a first edge and a second edge, said first edge forming a release notch to allow said tab to move into said disengaged position, wherein rotational misalignment of said release notch and tab maintains the tab in its engaged position, and wherein alignment of said release notch and tab results in said tab transitioning to its disengaged position, said first edge having formed thereon ratcheting teeth to engage a ratchet spring lock affixed to said casing sub to prevent bi-directional movement of said first ratchet band, and said second edge forming thereon ratcheting teeth;

a second ratchet band capable of circumferential movement about said casing sub, said second ratchet band having a first edge and a second edge, said first edge forming ratcheting teeth capable of engagement with said second edge of said first ratchet band so as to allow unidirectional rotation as between said first ratchet band and said second ratchet band, said second edge also forming a notch capable of receiving a spring-end bushing;

a spring-end bushing;

at least one wrap band spring positioned under the second ratchet band a compression spring fitted around the circumference of said casing sub, said spring having a first end and a second end, said first end being adapted to engage said spring-end bushing, said second end being adapted to engage a notch, said compression spring expanding in response to an increase in the diameter of said casing sub, wherein said compression spring tensions and causes rotation of said second ratchet band and said first ratchet band in a first direction, and wherein said compression spring relaxes in response to a decrease in the diameter of said casing sub and causes rotation of said second ratchet band in a second direction;

and a cover fitted around said first ratchet band, said second ratchet band, and said compression spring.

8. The locking mechanism of claim 7 wherein said receptacle defines holes and wherein ball bearings are inserted into said holes to engage said recesses in said casing sub, and wherein upon engagement of said receptacle with said tab, a nose of said tab maintains said ball bearings in said recesses in said casing sub to prevent movement of said centralizer sub.

9. The locking mechanism of claim 7 wherein said receptacle includes pivoting appendages capable of engaging said recesses in said casing sub, said pivoting appendages being held apart by engagement with said tab to prevent movement of said centralizer sub.

10. A casing sub having a deployable bow spring centralizer mounted on a casing sub, comprising in axially stackable relation: a selectively releasable locking mechanism; first and second ratchet bands; an expandable band comprising: at least one compression spring fitted around said casing sub; and at least one wrap band spring fitted around said casing sub; and an end band.

* * * * *